United States Patent [19]

Marder et al.

[11] 4,069,078

[45] Jan. 17, 1978

[54] PROCESS FOR FINISHING A NONWOVEN FILM-FIBRIL SHEET

[75] Inventors: Milton David Marder; Robert Osmalov, both of Richmond, Va.; Gerald P. Pfeiffer, Wilmington, Del.

[73] Assignee: E. I. Du Pont de Nemours and Company, Wilmington, Del.

[21] Appl. No.: 717,006

[22] Filed: Aug. 23, 1976

[51] Int. Cl.[2] ..... B32B 27/00

[52] U.S. Cl. ..... 156/181; 156/209; 156/306

[58] Field of Search ..... 156/181, 167, 163, 166, 156/161, 280, 306, 209, 219; 428/198, 296; 19/155, 161 P; 162/206

[56] References Cited

U.S. PATENT DOCUMENTS

| | | | |
|---|---|---|---|
| 3,169,899 | 2/1965 | Steuber | 156/62.2 |
| 3,442,740 | 5/1969 | David | 156/181 |
| 3,478,141 | 11/1969 | Dempsey et al. | 156/166 |
| 3,536,552 | 10/1970 | Lee | 156/166 |
| 3,715,251 | 2/1973 | Prentice | 156/290 |

FOREIGN PATENT DOCUMENTS

| | | | |
|---|---|---|---|
| 1,245,088 | 9/1971 | United Kingdom | 156/167 |

*Primary Examiner*—William A. Powell
*Assistant Examiner*—Michael W. Ball

[57] ABSTRACT

There is disclosed a finishing process for preparing a bonded, nonwoven, polyethylene, film-fibril sheet having high delamination strength and uniformity of appearance comprising selecting a particular starting sheet which is lightly consolidated, embossing the lightly consolidated sheet in a particular manner, passing the resulting sheet, under restraint, through a heating zone to cause a specified amount of fusion of surface film-fibrils, and heat treating the other surface of the sheet similarly to obtain a bonded sheet having a specified opacity.

4 Claims, No Drawings

PROCESS FOR FINISHING A NONWOVEN FILM-FIBRIL SHEET

BACKGROUND OF THE INVENTION

This invention relates to an improved finishing process for nonwoven sheets of polyethylene film-fibrils. In particular, this invention relates to a process for preparing a nonwoven, polyethylene, film-fibril sheet which has high delamination strength and uniformity of appearance.

Nonwoven sheets of polyolefin film-fibrils, particularly polyethylene, are utilized for book binding as a replacement for cloth which is more expensive. For this application, the nonwoven sheet should be printable, opaque, uniform in appearance, and durable, i.e., have high delamination strength and high abrasion resistance. Nonwoven, polyolefin, film-fibril sheets formed by deposition of continuous fibrillated strands onto a moving belt can be compressed and/or fused, e.g. by calendering or by hot air treatments, to develop further certain desirable qualities. However, a sheet treated in such manner tends to have non-uniform translucent areas. Efforts to achieve uniformity of appearance simultaneous with the other qualities desired in a non-woven sheet to be used as a book cover have led to considerable research and have been the subject of several patents.

U.S. Pat. No. 3,442,740, issued to David on May 6, 1969, discloses a finishing process for making a nonwoven sheet which has uniform high opacity, a high degree of flatness, high surface stability, and high delamination resistance. The disclosed process comprises thermally bonding a film-fibril sheet by subjecting it in a heating zone to light compression between two surfaces thereby preventing shrinkage, the first surface being a hard heat-conducting material and being maintained at a temperature substantially equal to or greater than the upper limit of the melting range of the film-fibril elements throughout the treatment, the second surface being a flexible, poor heat conductor, the film-fibril sheet being exposed long enough to allow the face of the sheet exposed to the hard heat conducting material to reach a temperature within 7° C of the upper limit of the melting range of the film-fibril elements, but not substantially above said upper limit, and to allow the second face of the sheet to reach a temperature 0.8° to 10° C lower than the first face of the sheet, finally directly passing the sheet while under restraint through a cooling zone wherein the temperature of the film-fibril sheet throughout its thickness is reduced to a temperature less than that at which the sheet will distort or shrink when unrestrained.

It was later found that while the process of the David patent provides sheets with good uniform opacity, this quality seemed to be somewhat dependent upon the history of the sheet prior to bonding. U.S. Pat. No. 3,536,552, issued to Lee on Oct. 27, 1970, is directed to this problem and discloses a process which comprises providing a lightly consolidated film-fibril sheet having a density of 0.11 to 0.26 g/cm$^3$, a basis weight of 10 to 200 g/m$^2$ and a coefficient of variation in basis weight of less than 0.15 (15%); passing this sheet through a constant clearance nip between a pair of hard calender rolls at substantially room temperature, said clearance being adjusted to provide a new sheet thickness between 0.5 and 0.85 of the thickness of the lightly consolidated film-fibril sheet; passing the sheet through a heating zone, while under restraint to prevent shrinkage, and raising the temperature of either face of the sheet to within 7° C of the upper limit of the melting range of the film-fibrils but not substantially above said upper limit; then cooling the sheet while under restraint to a temperature below that at which the sheet distorts or shrinks.

The process disclosed by the Lee patent requires rather stringent control of the basis weight uniformity, i.e., coefficient of variation of less than 0.07 (7%), during production of the lightly consolidated sheet in order to obtain a starting sheet capable of being thereby finished into a sheet having the high delamination strength, as defined later herein, while still having uniformity of appearance. Moreover, it has been found that often as productivity is increased, the basis weight uniformity diminishes. A process which could utilize nonwoven sheets displaying a somewhat lesser uniformity of basis weight would greatly alleviate the conflicting needs for greater uniformity and greater productivity.

SUMMARY OF THE INVENTION

The present invention is a process for preparing a bonded, nonwoven, polyethylene, film-fibril sheet having high delamination strength and uniformity of appearance comprising (1) providing a lightly consolidated, nonwoven, film-fibril sheet having a basis weight of from about 34–119 g/m$^2$ (1–3.5 oz/yd$^2$), a coefficient of variation in basis weight, normalized to 68 g/m$^2$ (2 oz/yd$^2$) basis weight, of from about 8–15%, and an average density of from about 0.2–0.4 g/cc; (2) passing said sheet through a nip formed between two rolls, while applying a nip pressure of from about 1.7–6.2 MPa (250–900 psi); one of the rolls having a multiplicity of bosses over practically its entire surface and extending from the surface of the roll to a height of from about 50–100% of the thickness of the lightly consolidated sheet, said bosses having tips which have at least one dimension being less than about 0.64 cm (0.25 in) and the most prominent of which, in aggregate, form an area which is from 1–50% of the area of the surface of the roll; the other roll having a surface with a durometer hardness of from about 55–80 as measured on the Shore D scale; (3) passing the resulting sheet, while under restraint, through a heating zone and raising the temperature of one surface of the sheet sufficiently to cause fusion of surface film-fibrils so as to obtain a sheet having an abrasion resistance of at least two cycles and then cooling the sheet, while under restraint, to a temperature below that at which the sheet distorts or shrinks; and (4) repeating step (3) with the opposite side of the sheet to obtain a bonded sheet with an opacity of more than about 72% but less than about the value obtained from the equation.

$$\% \text{ opacity} = 92 - 1.9\sqrt{121 - \text{basis weight}},$$

said basis weight being that of the final product.

DETAILED DESCRIPTION OF THE INVENTION

The nonwoven, polyethylene, film-fibril sheet used in the process of the invention can be prepared by the method of Steuber, U.S. Pat. No. 3,169,899, followed by the "fixed nip calendering" step of Lee, U.S. Pat. No. 3,536,552. In the Steuber method, a solution of the desired polyolefin is flash-spun from one or more spinnerets to obtain continuous fibrillated strands which are directed by means of a rotating or oscillating baffle to a collecting moving belt. The amount of spreading which is accomplished by each deflector and the degree of overlap is carefully controlled to give as uniform distribution of fibers on the collecting belt as possible. The collected sheet is lightly consolidated by passage on the belt under a roll which applies a loading of less than 18 kg/cm (100 lbs/linear inch) to obtain a sheet which is then passed through a calender of the type commonly described as "a fixed nip calender" to provide the lightly consolidated sheet used as the starting material in the present process.

The starting sheet for the present process should have a basis weight of from about 34–119 g/m² (1–3.5 oz-/yd²), a coefficient of variation in basis weight, normalized to 68 g/m² (2 oz/yd²) basis weight, of from about 8–15%, and an average density of from about 0.2–0.4 g/cc. If the sheet is not sufficiently uniform, i.e., if the sheet has coefficient of variation of greater than 15%, an unattractive non-uniform product will result. As used herein, average density means the basis weight obtained by weighing at least 1.7 square meters (2 square yards) of sheet divided by the average thickness obtained from at least 20 individual measurements across the sheet.

The lightly consolidated sheet is passed through a nip formed between two rolls while there is applied a nip loading sufficient to provide an average nip pressure of from 1.7–6.2 MPa (250–900 psi).

The average nip pressure, as used herein, is determined by dividing the nip loading (force/unit length) by the nip width. The nip width is determined by closing the nip under a predetermined loading on either a thin metal foil or a sandwich of white paper and carbon paper, opening the nip, and measuring the average width of the imprint.

One of the rolls is an embossing roll which has a multiplicity of bosses over practically its entire surface. Suitable embossing rolls have bosses which extend from the surface of the roll to a height of from about 50–100%, preferably from about 55–75%, of the thickness of the lightly consolidated sheet. Using an embossing roll with tips extending a height greater than 100% of the thickness of the sheet may give a sheet having high delamination and uniform appearance, but the resulting sheet will have an uneven topography rendering it undesirable as a book cover material. The bosses have tips (lands) which at least in one dimension are a length of less than about 0.64 cm (0.25 in). The most prominent bosses form at the tips a cross-sectional area, which, in aggregate, is from about 1–50%, preferably about 15–35%, of the area of the surface of the roll. The expression "the most prominent bosses" as used herein means bosses having tip heights within 50% of the maximum tip height. The total area of the most prominent bosses is determined by closing the nip between the embossing roll and the backup roll under the specified nip loading to statically emboss a 0.025–0.038 mm (1–1.5 mil) thick aluminum foil placed in the nip and then measuring with a suitable calibrated microscope the regions in the foil displaced by these bosses. The pattern of the bosses is preferably a "linen" pattern. Suitable "linen" embossing rolls are available from Inta-Roto, Inc., Richmond, Va.

The embossing can be either hot or cold, but is preferably cold. By the expression cold embossing it is meant that the embossing roll is at ambient temperature (approximately 20° C–30° C). If cold embossing is employed, the process is insensitive to the speed of the sheet through the nip. If hot embossing is utilized, the sheet is passed through the nip at a speed high enough to minimize sticking of the sheet to the embossing roll.

The opposite roll employed in the embossing step is a backup roll and has a surface with a durometer hardness of from about 55–80, preferably 60–75, as measured on the Shore D scale. The Shore equipment for measuring durometer hardness is manufactured by Shore Instrument Manufacturing Co., Inc., 20–25 Van Wyk Expressway, Jamaica, N.Y. The durometer test is described in ASTM method D-1706-61 and in D-1484-59.

After the lightly consolidated sheet is embossed as described above, it is then passed, under restraint, to a heating zone where the temperature of one surface of the sheet is raised sufficiently to cause fusion of surface film-fibrils so as to obtain a sheet surface having an abrasion resistance of at least two cycles. Fusion is conveniently effected by the apparatus described in David, U.S. Pat. No. 3,442,740, column 2, lines 54–72, column 3, lines 1–18, and FIG. 1 thereof, which description is incorporated herein by reference. The apparatus described in said patent is a modification of the palmer apparatus commonly used in textile finishing. In textile dictionaries it is sometimes referred to as a palmer finisher or palmer dryer. The apparatus is normally used for drying or for heat-setting woven fabrics at relatively mild temperatures. The David patent describes certain modifications made to the palmer apparatus as customarily used, for instance, to enable cooling of the fabric while under restraint. The restraint required in the present process during the heating and cooling operations is a pressure sufficient to prevent shrinkage of the sheet, which is generally about 0.0069MPa (1 lb/in²). Excessive pressures should be avoided as they will tend to cause losses in opacity and bulk.

If the surface film-fibrils of the sheet are not fused sufficiently to obtain the specified abrasion resistance, the sheet will not possess high delamination strength. The expression "high delamination strength", as used herein, means a delamination resistance of at least 16 kg/m (0.9 lb/in).

After the required fusion has been effected, the sheet is cooled, under compressional restraint, to a temperature below that at which the sheet distorts or shrinks. The temperature below which the sheet must be cooled can readily be determined by experimentation, but will usually be at least 30° C below the upper limit of the melting range of the film-fibrils.

After the first surface of the sheet has undergone the required fusion and cooling, the other surface of the sheet is similarly heated. It is important that the combined heat treatment of both surfaces of the sheet be sufficient to obtain a bonded sheet with an opacity of more than about 72% but less than about the value calculated from the equation, % opacity $= 92 - 1.9 \sqrt{121 - \text{basis weight}}$, said basis weight being expressed in g/m² and being the basis weight of the final product. This equation was empirically obtained and due to the inaccuracy of the opacity measurement, the process of the invention can be operated to obtain a sheet having an opacity up to about 2% higher than that defined by this equation and still be within the bounds of the invention. If the sheet is fused to a degree beyond the level specified herein, the resulting opacity of the sheet will be too low for use as book covering material. If the degree of fusion is below that set forth by the above requirements, high delamination strength cannot be ensured. Alternatively, if suitable apparatus is available, fusion of both surfaces of the sheet may be effected simultaneously.

The polyethylene film-fibril sheet used in the present process can be linear polyethylene or copolymers of linear and branched polyethylene. Homopolymeric linear polyethylene is preferred for the process of the invention. This material as preferred for the present invention will normally have an upper limit of the melting range of about 130°–135° C, a density of from about 0.94–0.98 g/cm³, and a melt index (ASTM method D-1238-57T, condition E) of 0.1 to 1.5. The plexifilament strands of film-fibrils which comprise the sheet can contain a wide range of additives, such as waxes, dyes, pigments and delustrants. Of course, the process of the invention can be extended so that other polyolefin sheets can be used; however, the equation for the opacity could be different.

The process of the invention provides a method of preparing a bonded, nonwoven, polyethylene, film-fibril sheet having high delamination strength and uniformity of appearance, i.e., minimal cracked ice (translucent streaks) and splotchiness. Although the present process is not limited by any theory, it is thought that the present process gives a product having high delamination strength and uniformity of appearance by achieving sufficient compaction of the sheet prior to surface fusion so that heat conductivity sufficient to obtain good internal bonding is effected before the surface becomes overbonded and by accomplishing compaction in a non-uniform but controlled manner so that non-uniformities, such as ropes and splotches as defined in British patent specification No. 1,425,116, in the sheet are not emphasized.

CHARACTERIZATION METHODS

The coefficient of variation (CV) is calculated in the usual manner as $$CV = (\sigma/\overline{X}) \cdot 100$$

where $\sigma$ is the standard deviation and $\overline{X}$ is the average of the measurements, these latter expressions being defined as $$\sigma = \sqrt{\frac{\sum_{i=1}^{n} (X_i - \overline{X})^2}{n-1}}$$

wherein $X_i$ = the individual measurements and $n$ = the total number of measurements.

The CV of the sheet uniformity is obtained by using a sheet about 1270 cm (500 in) in length and at least about 20 cm (8 in) in width. From this sheet, 80 2.5 cm (1 in) diameter circles are cut along three rows, the center-center distances of these circles being about 7.6 cm (3 in) in the width direction of the sheet and about 15 cm (6 in) in the length direction. The coefficient of variation of the weights of these 2.5 cm circles in each row is calculated and the average coefficient of variation for the three rows is used as a measure of the sheet uniformity.

In order to make comparisons between materials having different sheet basis weights, a normalized CV is calculated. The normalized CV expresses results in terms of a 68 g/m² (2 oz/yd²) sheet and is calculated from the following expression:

$$CV\,(\text{normalized}) = CV\,(\text{measured}) \cdot \sqrt{\frac{\text{sheet basis weight}}{68}},$$

said basis weight being in g/m². Low values of CV indicate better sheet uniformity.

Abrasion resistance, as used herein, is determined by means of the Crockmeter tester, S.N. CM-598, of Atlas Electric Device Company, Chicago, Ill. A 12.7 cm × 12.7 cm (5 in × 5 in) piece of silicon carbide paper is taped to the base of the crockmeter directly under the full movement of the rubber foot. The carbide paper serves to prevent the sample from moving. A rubber finger stall (finger tip) is fastened to a circular plastic foot on the swing bar. The finger stall is size 12 and is obtained from Swingline Incorporated, Long Island City, N.Y. The swing bar handle is turned so therefore that the rubber foot traverses back and forth across the surface of the sample. When the first surface fiber is disturbed (pops up), the number of cycles is determined from the counter on the instrument. The average number of cycles for five tests is reported for each sample.

Delamination resistance or strength is measured using an Instron Tester, 2.5 cm × 7.6 cm (1 in × 3 in) line contact clamps, and an Instron Integrator, all manufactured by Instron Engineering, Inc., Canton, Mass. Delamination of a 2.5 cm (1 in) × 17.8 cm (7 in) specimen is manually started across a 2.5 cm × 2.5 cm (1 in × 1 in) edge area (so that the remaining portion remains unseparated) by splitting the sheet with a pin. With a "C" load cell, the following settings are used: gauge length of 2.5 cm (1 in), crosshead speed of 12.7 cm (5.0 in) per minute, chart speed of 5.1 cm (2.0 in) per minute and full scale load of either 0.91 kg (2 lbs) or 2.3 kg (5 lbs). A sample is placed in each of the line clamps and the force which is required to pull the sheet apart is measured. Delamination resistance (lbs/in) equals the integrator reading divided by the appropriate conversion factor which depends upon load cell size and units of measurement.

The opacity is determined by measuring the quantity of light transmitted through individual 5.1 cm (2 in) diameter circular portions of a sheet by employing an E.B. Eddy Opacity Meter, manufactured by Thwing Albert Instrument Company. The opacity of the sheet is determined by arithmetic averaging of at least eight such individual determinations.

The invention is further described by the following examples.

EXAMPLES 1 - 6

Lightly consolidated, nonwoven sheets composed of continuous strands of film-fibrils of linear polyethylene having a density of about 0.95 g/cc, a melt index of 0.9 (ASTM method D-1238-57T, condition E), and an upper limit of the melting range of about 131° C are prepared by the process of Steuber, U.S. Pat. No. 3,169,899 followed by the "fixed nip calendering" step of Lee, U.S. Pat. No. 3,536,532. Six sheets having the basis weight and densities given in Table 1 and a normalized CV of from 10–12% are selected and each subsequently treated as described below.

The sheet is embossed at ambient temperature (20° C) by passing it through a nip formed by an embossing roll possessing a "linen" pattern and a backup roll having a durometer hardness of 75 on the Shore D scale. The total area of all the most prominent bosses on the roll is about 16% of the area of surface of the embossing roll. Other process conditions are given in Table 1. The resulting sheet is passed while under a restraining pressure of about 0.0069 MPa (1 lb/in²) through a heating zone using a bonding apparatus similar to that described in David, U.S. Pat. No. 3,442,740, whereby at first one surface of the sheet is heated to fuse the surface film-fibrils to obtain an abrasion resistance of at least 2 for that surface. The sheet is cooled, while under restraint, to a temperature below that at which shrinkage occurs. The bonder drum had a 300° wrap. Next the other surface of the sheet is similarly treated to obtain a sheet with the opacity shown in Table 2. Uniformity of appearance and delamination strength for each sheet are given in Table 2.

unit, i.e., the arms of the crosses along a given line lie halfway between the arms of the crosses in the adjacent line. The embossing surface of the cross stands 0.25 mm (0.010 in) above the face of the embossing roll. The total area of all the most prominent bosses in the roll is about 25% of the area of the surface of the roll.

The sheet is then heat treated in a manner similar to that described in Examples 1–6 using a 1.5 m (5 ft) diameter drum with 300° wrap. The temperature to which the first surface is exposed is 141° C and the other surface of the sheet is exposed to a temperature of 142° C. The resulting sheet had a basis weight of 115 g/m² (3.4 oz/yd²) and an opacity of 87%. The sheet possesses uniformity of appearance and has a delamination strength of 170 g/cm (0.95 lb/in).

TABLE 1

| Example | Basis Weight g/m²(oz/yd²) | Bonder Roll Size m (ft) | Thickness mm (mil) | Average Density (g/cc) | Nip Pressure PMa (psi) | Pattern Depth mm (mils) | Bonding Temp., °C* | Bonding Speed m/min (y/min) |
|---|---|---|---|---|---|---|---|---|
| 1 | 81.7 (2.41) | 2.2(7) | 29.2 (11.5) | 0.28 | 2.6 (380) | ~19 (~7.5) | 147/147 | 78 (85) |
| 2 | 86.1 (2.54) | 2.2(7) | 31.8 (12.5) | 0.27 | 2.6 (380) | ~19 (~7.5) | 147/147 | 78 (85) |
| 3 | 76.6 (2.26) | 2.2(7) | 28.4 (11.2) | 0.27 | 2.8 (400) | ~19 (~7.5) | 146/146 | 91 (100) |
| 4 | 100 (2.95) | 1.5(5) | ~31.8 (~12.5) | ~0.31 | 3.6 (520) | ~22 (~8.5) | 142/145 | 46 (50) |
| 5 | 61 (1.8) | 1.5(5) | ~24 (~9.5) | ~0.25 | 3.6 (530) | ~22 (~8.5) | 141/142 | 46 (50) |
| 6 | 52.2 (1.55) | 1.5(5) | ~22 (~8.5) | ~0.24 | 4.8 (690) | ~22 (~8.5) | 140/140 | 46 (50) |

*The bonding temperature is given for each side of the sheet.

TABLE 2

| Example | Basis Weight of Finished Product g/m² (oz/yd²) | | Opacity (%) | Delamination kg/m (lb/in) | | Uniform Appearance |
|---|---|---|---|---|---|---|
| 1 | 85.4 | (2.52) | 77.1 | 18.4 | (1.03) | yes |
| 2 | 90.5 | (2.67) | 78.6 | 17 | (0.97) | yes |
| 3 | 79.3 | (2.34) | 80.8 | 16 | (0.90) | yes |
| 4 | 107 | (3.15) | 84.9 | 18 | (0.98) | yes |
| 5 | 68 | (2.0) | 74.5 | 19.1 | (1.07) | yes |
| 6 | 58 | (1.7) | 77 | 17 | (0.94) | yes |

EXAMPLE 7

Using the procedure of Examples 1–6, there is prepared a lightly consolidated, nonwoven sheet composed of continuous strands of film-fibrils of linear polyethylene having the properties set forth in Examples 1–6. The lightly consolidated sheet has a basis weight of about 102 g/cm² (3.0 oz/yd²), a normalized CV of from 10–12%, and a density of about 0.31 g/cc.

The sheet is embossed at ambient temperature (about 20°–30° C) by passing it through the nip formed by an embossing roll and a backup roll having a durometer hardness of 75 as measured on the Shore D scale. The nip pressure is about 2.3 MPa (about 335 psi). The embossing roll is 25 cm (10 in) in diameter and has its entire surface covered with an array of bosses in the form of small individual crosses formed from two bars each 0.10 mm by 1.4 mm (0.004 in by 0.055 in) which intersect at right angles. The point of intersection occurs at the mid-point of the arm of the cross and at a point 0.30 mm (0.012 in) from the top of the stem of the cross. The crosses are arranged in a regular pattern such that their stems fall on a grid of parallel lines spaced 1.3 mm (0.050 in) apart. The crosses along any given line occur at 1.8 mm (0.070 in) intervals, with the top end of each cross pointing in the same direction. The crosses in the adjacent lines also point in the same direction, which is therefore called the axis of the pattern, with those crosses displaced along the line by one-half a repeat

We claim:

1. A process for preparing a bonded nonwoven sheet of polyethylene film-fibrils, said sheet having high delamination strength and uniformity of appearance, said process comprising 1. providing a lightly consolidated, non-woven, film-fibril sheet having a basis weight of from about 34–119 g/m² (1–3.5 oz/yd²), a coefficient of variation in basis weight, normalized to a 68 g/m² (2 oz/yd²) basis weight, of from about 8 – 15%, and a density of from about 0.2–0.4 g/cc;
2. passing the lightly consolidated sheet through a nip formed between two rolls while applying a nip loading sufficient to provide an average nip pressure of from about 1.7–6.2 MPa (250–900 psi); one of said rolls having a multiplicity of bosses over practically its entire surface and extending from the surface of the roll to a height of from about 50–100% of the thickness of the lightly consolidated sheet, said bosses having tips which have at least one dimension being less than 0.64 cm (0.25 in) and the most prominent of which, in aggregate, form an area which is from about 1–50% of the area of the surface of the roll; the other roll having a surface with a durometer hardness of from about 55–80 as measured on the Shore D scale;

3. passing the resulting sheet, while under restraint, through a heating zone and raising the temperature of one surface of the sheet sufficiently to cause fusion of surface film-fibrils so as to obtain a sheet having an abrasion resistance of at least two cycles and cooling the sheet, while under restraint to a temperature below that at which the sheet distorts or shrinks; and 4. repeating step (3) with the opposite side of the sheet to obtain a bonded sheet with an opacity of more than about 72% but less than about the value obtained from the equation, % opacity = $92 - 1.9\sqrt{121 - \text{basis weight}}$, said basis weight being the basis weight of the finished product in g/m².

2. The process of claim 1 wherein the tips of the most prominent bosses, in aggregate, form an area which is from about 10–35% of the area of the surface of the roll.

3. The process of claim 1 wherein the polyethylene is linear polyethylene.

4. The process of claim 1 wherein the temperature in step (2) is ambient temperature.

* * * * *